US005870844A

United States Patent [19]

Lin

[11] Patent Number: 5,870,844

[45] Date of Patent: Feb. 16, 1999

[54] TRANSMISSION STRUCTURE FOR ORNAMENTS

[76] Inventor: Hsi-Chun Lin, 5F-7, No. 63, Sec. 2, Chang-An E. Rd., Taipei, Taiwan

[21] Appl. No.: 797,235

[22] Filed: Feb. 7, 1997

[51] Int. Cl.[6] ..... G09F 19/08

[52] U.S. Cl. ..... 40/411; 40/414; 40/415; 74/665 GA; 446/357

[58] Field of Search ..... 40/406, 411, 414, 40/415, 430, 433; 74/665 GA; 446/357

[56] References Cited

U.S. PATENT DOCUMENTS

| | | | |
|---|---|---|---|
| 1,566,479 | 12/1925 | Horvath et al. | 40/411 |
| 3,122,946 | 3/1964 | Hedges | 74/665 GA |
| 4,785,362 | 11/1988 | Nozawa et al. | 74/665 GA |
| 4,983,890 | 1/1991 | Satoh et al. | 40/414 |
| 5,134,795 | 8/1992 | Wang | 40/411 |
| 5,412,890 | 5/1995 | Fechter | 41/414 |
| 5,458,012 | 10/1995 | Liu | 40/411 X |
| 5,609,341 | 3/1997 | Chuang | 40/414 X |
| 5,655,321 | 8/1997 | Chang | 446/357 X |
| 5,675,921 | 10/1997 | Lin | 40/411 X |
| 5,706,596 | 1/1998 | How | 40/414 |
| 5,735,724 | 4/1998 | Udagawa | 446/172 |
| 5,775,014 | 7/1998 | Lin | 40/406 |

*Primary Examiner*—Kenneth J. Dorner
*Assistant Examiner*—Andrea Chop
*Attorney, Agent, or Firm*—Bacon & Thomas, PLLC

[57] ABSTRACT

A transmission structure for ornaments, in which the center of the base disk is mounted with a rotative ring, of which the bottom has a driving gear. The upper part of the rotative ring is connected with a round member with a ring-shaped plate; the inside of the round member has an inner gear to be engaged with a small gear of a music generator and driving unit. The outer edge surface of the base disk is furnished with at least a gear train to be engaged with the inner gear of a rotative disk, or with a transmission assembly. Different ornaments are mounted on the ring-shaped plate of round member, the upper side of the still disk, the circular surface of the rotative disk or the round shaft of the transmission assembly respectively. The aforesaid ornaments on the aforesaid parts are driven by means of the music generator and driving unit so as to rotate, to swing or to move back and forth.

12 Claims, 11 Drawing Sheets

TRANSMISSION STRUCTURE FOR ORNAMENTS

BACKGROUND OF THE INVENTION

1. Field of the Invention

This invention relates to a transmission structure, and particularly to a transmission structure which has a music and driving assembly to drive a plurality of ornaments to pose different gestures.

2. Description of the Prior Art

In the conventional transmission structure, such as mentioned in U.S. Pat. No. 5,134,795, the structure has a center shaft extended into a ball-shaped glass container; the upper end of the center shaft is mounted with a claw-shaped connector to drive a propeller to rotate. The center shaft is mounted with a gear, which is engaged with a gear train; the outer edge of the gear train is engaged with a ring gear. When the center shaft is driven to rotate, an ornament mounted on the gear train will also rotate, and the ring gear will drive the disk to turn.

Another conventional water ball device is shown in U.S. Pat. No. 4,983,890, of which the driving device comprises a drive mechanism unit and a transmission mechanism unit operatively connected to the drive mechanism unit. The drive mechanism unit includes a casing, in which a power supply, a sensor and a motor are arranged. The drive mechanism unit also includes an output shaft which is operatively connected to the motor and through which the transmission mechanism unit is connected to the drive mechanism unit. The motor is electrically connected to the power supply and sensor so as to be actuated when the sensor detects an external stimulus. The transmission mechanism unit includes an input section operatively connected to the output shaft of the drive mechanism unit to transmit the drive force of the drive mechanism unit to the transmission mechanism unit and a plurality of output sections for transmitting the power of the transmission mechanism unit to the exterior.

SUMMARY OF THE INVENTION

The prime object of the present invention is to provide a transmission structure for ornaments, in which the center of the base disk is mounted with a rotative ring, of which the bottom has a driving gear. The upper part of the rotative ring is connected with a round member with a ring-shaped plate; the inside of the round member has an inner gear to be engaged with a small gear of a music generator and driving unit. The outer edge surface of the base disk is furnished with at least a gear train to be engaged with the inner gear of a rotative disk, or with a transmission assembly. Different ornaments are mounted on the ring-shaped plate of round member, the upper side of the still disk, the circular surface of the rotative disk or the round shaft of the transmission assembly respectively. The aforesaid ornaments on the aforesaid parts are driven by means of the music generator and driving unit so as to rotate, to swing or to move back and forth.

Another object of the present invention is to provide a transmission structure for ornaments, in which the gear train furnished on the outer edge surface of the base disk is engaged with a driving gear on the bottom of the rotative ring; the gear train includes an odd or even number of gears, or a retarding gear train to be engaged with an outer gear so as to have the transmission assembly moved forwards or reversely, or to have the speed reduced.

Still another object of the present invention is to provide a transmission structure for ornaments, in which the outer edge surface of the base disk is furnished with several gear trains; the supporting posts of the gear trains are fixed on the still disk; the small gears of the outer edge thereof are engaged with the gears of the transmission assembly respectively; through the transmission assemblies, the ornaments mounted thereon can move and pose in various gestures.

A further object of the present invention is to provide a transmission structure for ornaments, in which the gear train mounted between the base disk and the still disk is connected with a swinging assembly through a retarding gear train; the swinging rod of the swinging assembly is pivotally mounted between two body members by using branch shafts; a round axle is furnished above the branch shafts, and the bottom thereof has a guide plate with a lateral guide channel, which is to be engaged with a short post of an eccentric rod; the axle hole of the eccentric rod is connected with a short shaft of a small gear, which is to be engaged with a retarding gear train or a gear train. When the small gear is driven with a force, the small gear will drive the short post of the eccentric rod to move circularly, and then such motion will be converted into a swinging motion of the swinging rod; then, an ornament mounted on the upper end of the swinging rod will swing.

A still further object of the present invention is to provide a transmission structure for ornaments, in which the gear train mounted between the base disk and the still disk is connected with a rotative assembly through a retarding gear train; the shaft of the rotative assembly passes through a shaft hole of the positioning disk, while the other end of the shaft is connected with a small gear, which is engaged with a retarding gear train. When it is driven with a force, the small gear will rotate to cause the shaft in the center thereof to rotate to cause the shaft in the center thereof to rotate so as to enable an ornament mounted on the upper end of the shaft to turn.

Yet another object of the present invention is to provide a transmission structure for ornaments, in which the gear train mounted between the base disk and the still disk is engaged with a displacing assembly through a retarding gear train; the displacing plate of the displacing assembly is fitted in the guide channel of the two body members; one of the two body members has a gear rack above the guide channel thereof, and the gear rack is to be engaged with a gear mounted on a short shaft of the displacing plate; the other body member has an elongate channel to provide a space for the gear to move. The bottom of the displacing plates has a lateral guide channel to be engaged with a short post on the eccentric rod. The circular motion of the short post of the eccentric rod can be converted into a reciprocating motion of the displacing plate; then, the gear on the displacing plate and the gear rack of the body member will have a relative motion so as to have an ornament mounted on the round shaft moved circularly and displaced.

Yet still another object of the present invention is to provide a transmission structure for ornaments, in which the gear train mounted between the base disk and the still disk is connected with a displacing assembly through a retarding gear train; the displacing plate of the displacing assembly is fitted in the symmetrical guide channels. The top side of the displacing plate is furnished with a round shaft for mounting a displacing ornament, and the bottom thereof is furnished with a guide channel to be engaged with a short post of the eccentric rod. The circular motion of the short post of the eccentric rod can be converted into a reciprocating motion of the displacing plate so as to let an ornament on the round shaft have a reciprocating motion.

DETAILED DESCRIPTION OF THE PREFERRED EMBODIMENT

Figure 1:
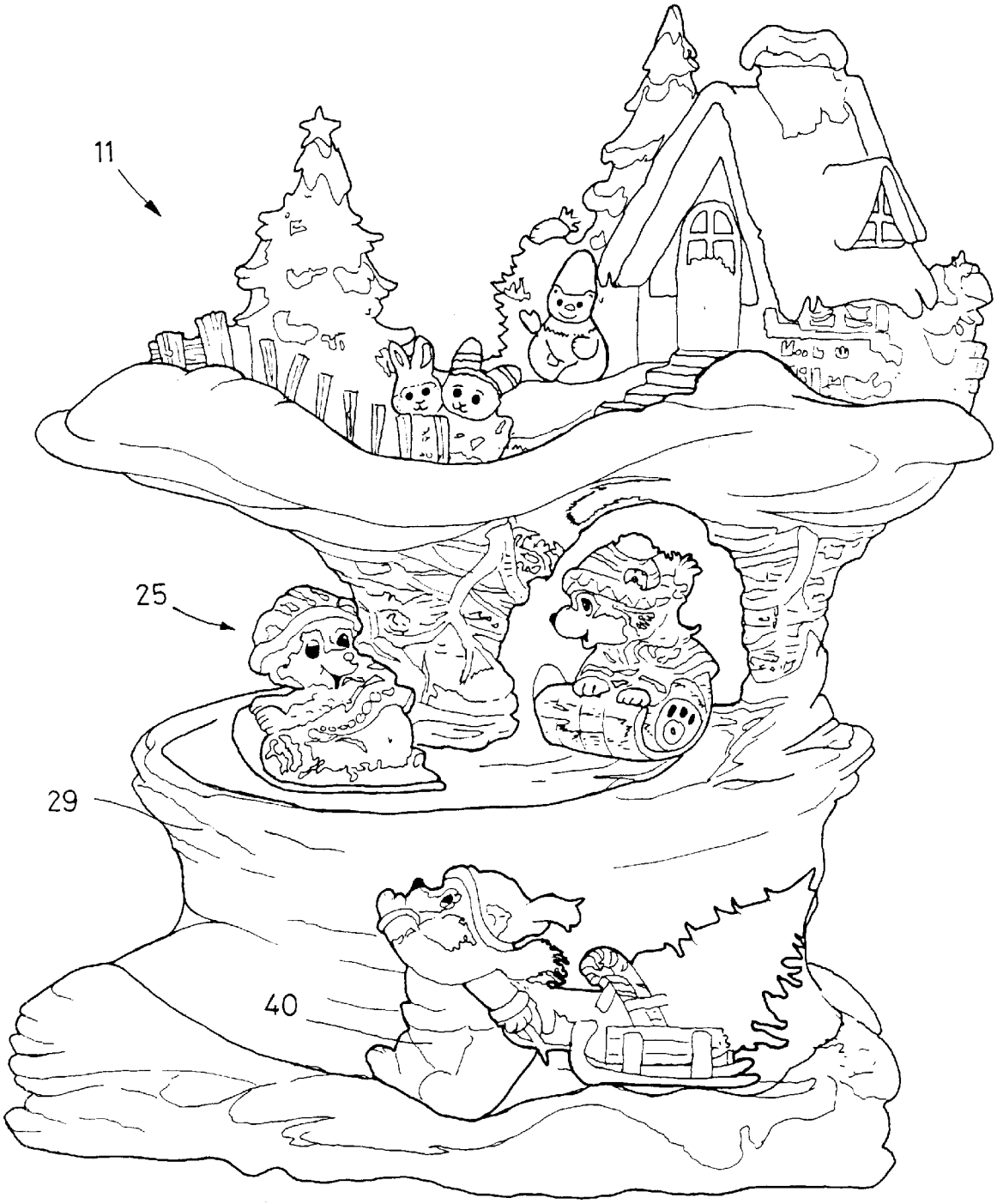
FIG. 1 is a perspective view of the present invention, showing an ornament to be driven with a transmission assembly.
Figure 2:
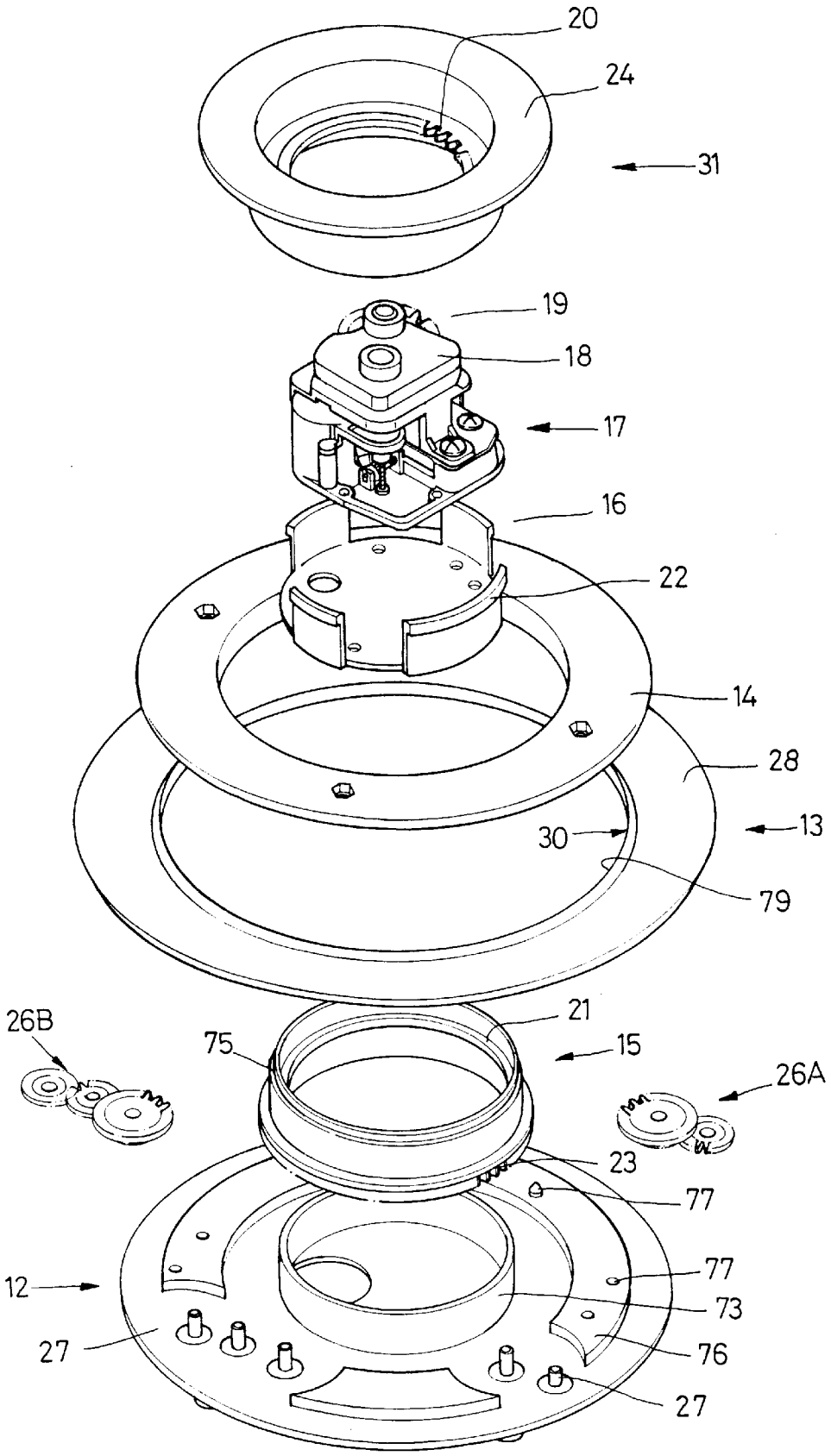
FIG. 2 is a disassembled view of the present invention, showing the relation among the major assemblies of the transmission structure.
Figure 3:
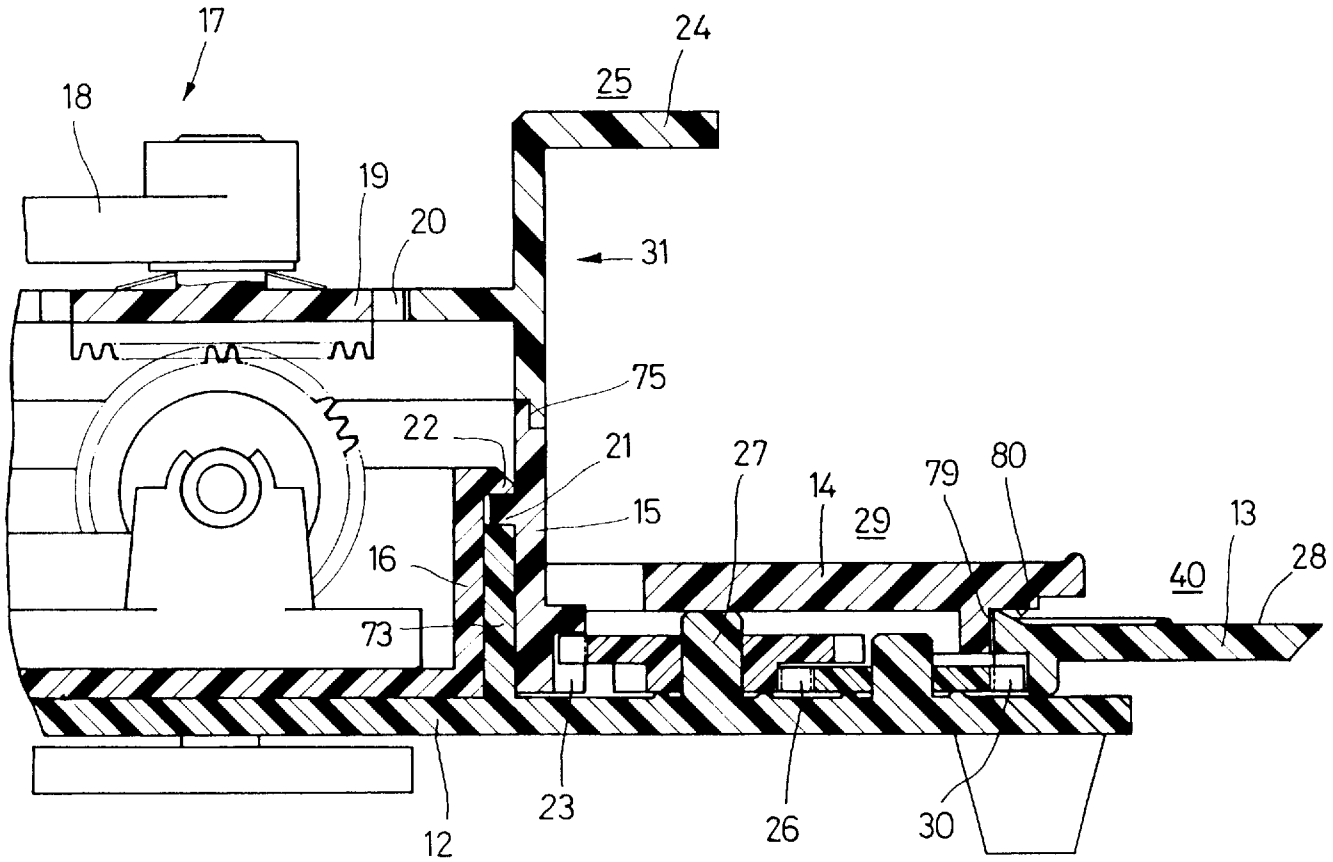
FIG. 3 is a fragmental section view of the present invention, showing the relation among the major assemblies of the transmission structure.

Referring to FIGS. 1 to 3, the present invention relates to a transmission structure for an ornament; the ornament 11 comprises a plurality of still ornament 29 and rotative ornaments 25 and 40; the still ornament 29 is mounted on a still disk 14; the rotative ornament 25 is mounted on a ring-shaped plate 24 of a round member 31; the rotative ornament 40 is mounted on a circular surface 28 of a rotative disk 13. A driving force is generated with a music generator 17, and the driving force is to be transmitted to the ring-shaped plate 24 of the round member 31 through the small gear 19 of the driving unit 18 and the inner gear 20 of the round member 31 so as to have the rotative ornament 25 to rotate. The gear 23 of the rotative ring 15 under the round member 31 can drive a gear train 26 so as to actuate the rotative ornament 40 on the rotative disk 13 to move.

Referring to FIGS. 2 and 3, the transmission structure includes a base disk 12 with a salient ring 73, and a rotative ring 15 is mounted on the salient ring 73; the inner surface of the rotative ring 15 is in close contact with the outer surface of the salient ring 73. The inner surface of the rotative ring 15 has an inner-ring shoulder 21, which is used to support the rotative ring 15 upon the same mounted on the salient ring 73. The salient ring 73 is substantially a hollow cylinder, in which a positioning cup 16 is mounted; the upper edge of the positioning cup 16 is furnished with several hooks 22 to be placed on the inner-ring shoulder 21 of the rotative ring 15; the music generator 17 assembled together with a driving unit 18 is fastened in the positioning cup 16 with screws. The hooks 22 of the positioning cup 16 are used to prevent the rotative ring 15 from separating outwards; the salient ring 73 of the base ring 12 is used to cause the rotative ring 15 to rotate.

The top of the driving unit 18 assembled together with the music generator 17 is mounted with a small gear 19 to be engaged with an inner gear 20 in the round member 31. The round member 31 and the rotative ring 15 are connected together as one piece. In addition to providing music, the music generator 17 with the driving unit 18 can drive the small gear 19 so as to actuate the round member 31 and the rotative ring 15 to rotate.

After the rotative ring 15 being mounted on the salient ring 73 of the base disk 12, the round member 31 will be mounted on an outer-ring shoulder 75 of the rotative ring 15 to form into one piece. The top edge of the round member 31 has a ring-shaped plate 24, on which a rotative ornament 25 is mounted; the small gear 19 is engaged with the inner gear 20 in the round member 31 so as to drive the rotative ornament 25 on the round member 31 to rotate. If the top edge of the round member 31 has no ring-shaped plate 24, the inner gear 20 in the round member 31 engaged with the small gear 19 of the driving unit 18 can only provide an output through the driving gear 23 of the rotative ring 15.

The driving gear 23 on the bottom edge of the rotative ring 15 is engaged with one or more gear trains 26 on the outer edge of the base disk 12. The outer edge of the gear train 26 is mounted with a rotative disk 13, and the inner gear 30 on the inner bottom of the rotative disk 13 engages with the gear train 26. The driving force is supplied from the driving gear 23 on the bottom of rotative ring 15, and transmitted through the gear train 26 to drive the rotative disk 13 to move.

The gear train 26 on the outer edge of the base disk 12 includes a plurality of supporting posts 27 mounted thereon. The gear train 26 may include an odd or even number of gears; when the outer edge of the gear train is engaged with the inner gear 30 of the rotative disk 13, the moving direction of the rotative disk 13 can be pre-determined, i.e., in a forward or reverse direction so as to determine the number of gears; a retarding gear train might be used for reducing the rotation speed of the rotative disk 13.

The supporting posts 27 furnished on the base disk 12 are arranged in accordance with the transmission requirement of the gear train 26; if the transmission gear are arranged on a plane, there is at least a gear being mounted between the driving gear 23 on the bottom of the rotative ring 15 and the inner gear 30 of the rotative disk 13, and such gear is an idle gear for transmitting driving force. If the gear train 26 is used as a retarding gear train, the gear train includes at least two gears, in which at least one gear is a retarding gear; the inner edge of the gear engages with the driving gear 23 on the bottom of the rotative ring 15, while the outer edge thereof engages with the inner gear 30 of the rotative disk 13 so as to provide a retarding function upon transmitting the driving force.

Between the two gear trains 26 on the base disk 12, there are several positioning plates 76 with a suitable inner and outer diameters, and height; the top surface of the positioning plates 76 are furnished with a plurality of positioning studs and small round holes 77. By means of the positioning studs and small round holes 77, the still disk 14, the base disk 12, the gear train 26 and the rotative disk 13 are assembled together to form into a transmission structure. The bottom of the inner round surface 79 of the rotative disk 13 is furnished with an inner gear 30, while the upper edge thereof is furnished with a smooth surface smaller than the diameter of the inner gear 30. After the rotative disk 13 is mounted on the outer circle of the positioning plate 76 on the base disk 12, the inner gear 30 will engage with the gear train 26. The inner round surface 79 of the rotative disk 13 has a smooth surface; when the still disk 14 is mounted on the positioning plate 76 of the base disk 12, the lower round surface 80 of the still disk 14 will be in contact with the smooth surface of the inner round surface 79 of the rotative disk 13. When the driving gear 23 on the bottom of the rotative ring 15 transmits a driving force to the gear train 26, the rotative disk 13 will rotate steadily.

Referring to FIGS. 1 to 3 again, the still disk 14 to be mounted on the positioning plate 76 has a circular flat side, on which a beautiful still ornament 29 is mounted; the ring-shaped plate 24 of the round member 31 is glued with a rotative ornament 25. The circular surface 28 of the rotative disk 13 is glued with a rotative ornament 40. After the inner gear 20 of the round member 31 is engaged with the small gear 19 of the driving unit 18 on the music generator 17, the rotative ornament 25 will be driven to move. The other rotative ornament 40 is driven to move by means of the inner gear 30 of the inner round surface 79 of the rotative disk 13 engaged with the gear train 26 of the base disk 12, and by means of the gear train 26 being engaged with the driving gear 23 on the bottom of the rotative ring 15

Figure 4:
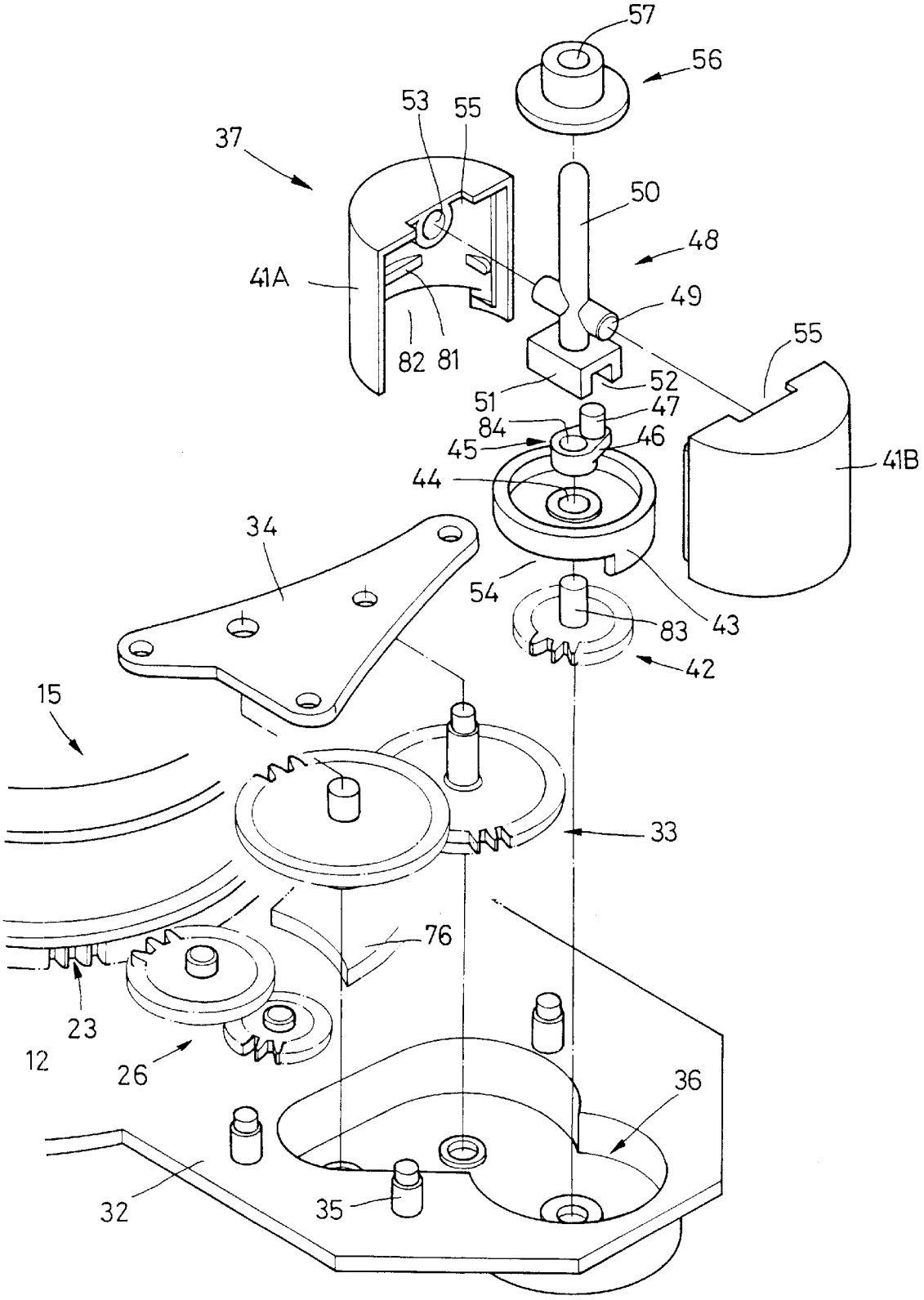
FIG. 4 is a disassembled view of the swinging assembly of the present invention, showing the structure relation among them.
Figure 5:
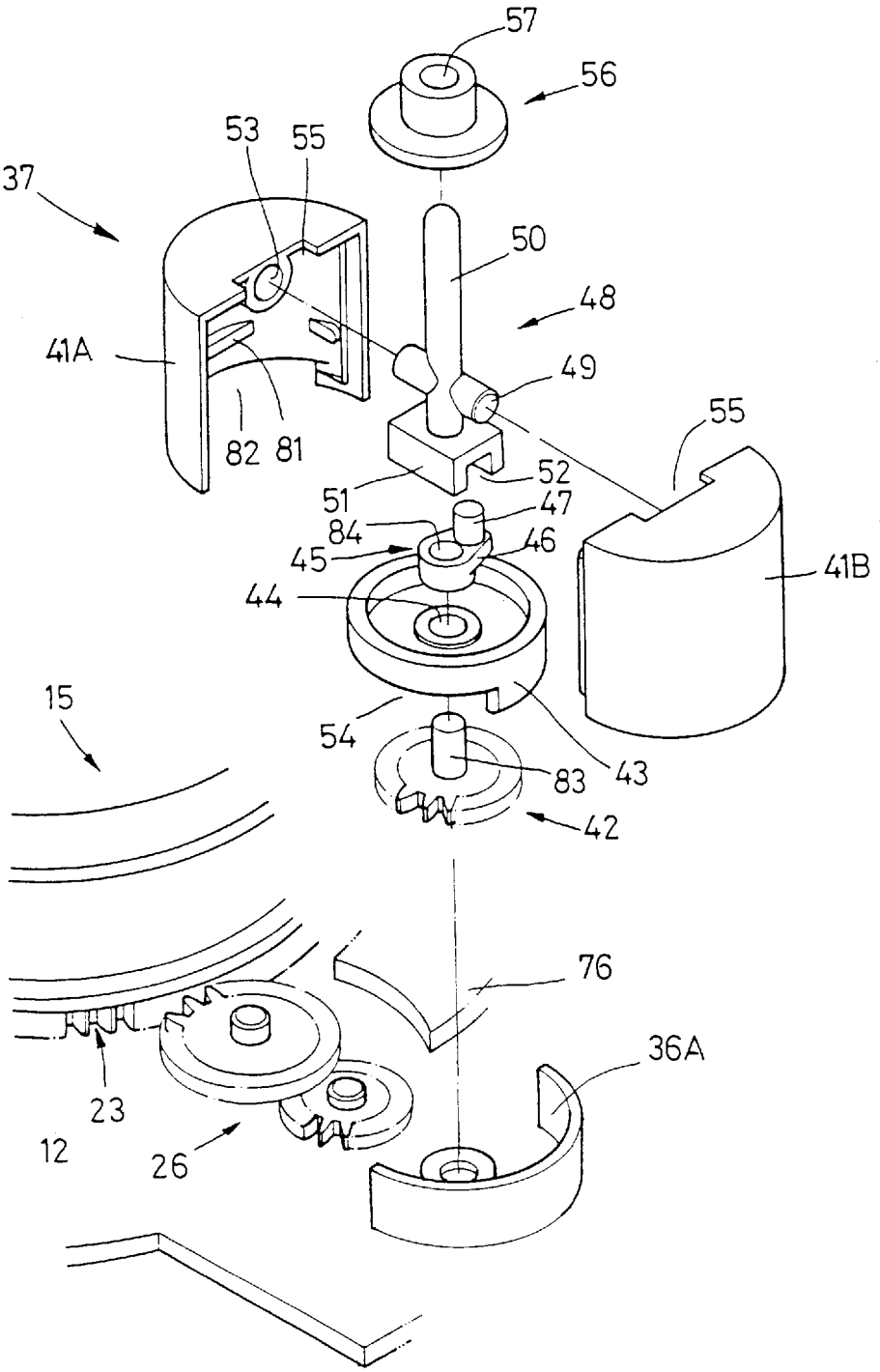
FIG. 5 is a disassembled view of the present invention, showing the connection relation between the swinging assembly and the gear train thereof.
Figure 6:
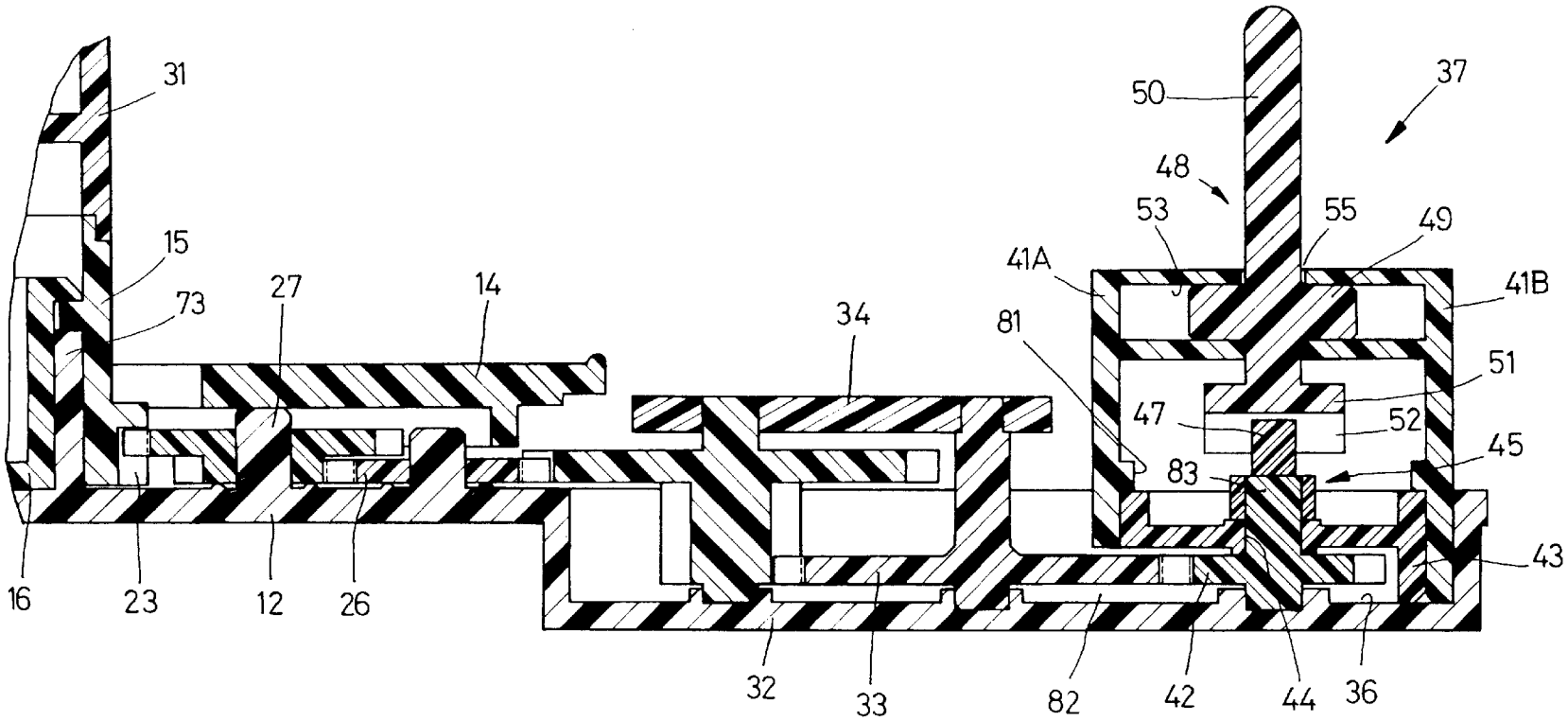
FIG. 6 is a fragmental section view of the present invention, showing the transmission structure of the swinging assembly thereof.
Figure 7:
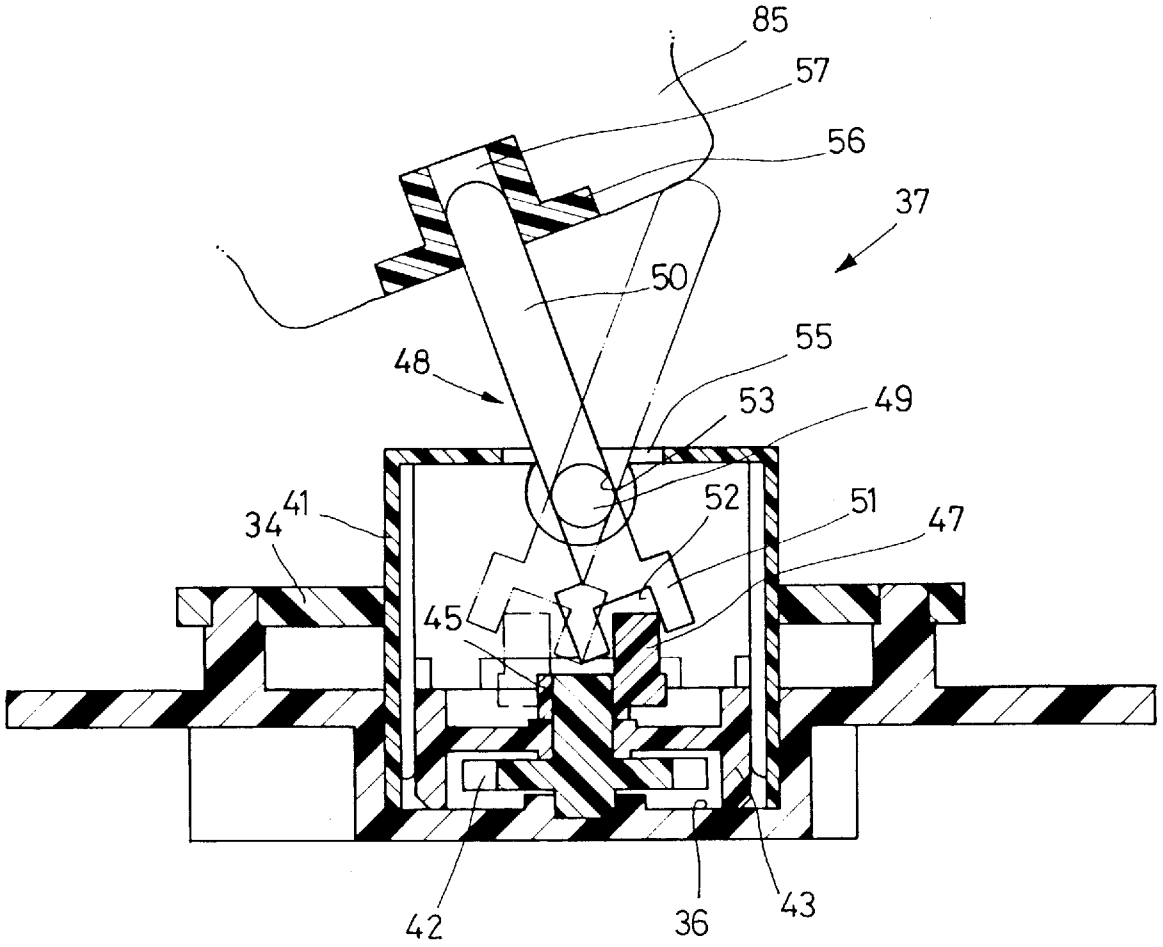
FIG. 7 is a fragmental section view of the present invention, showing the swinging assembly under a swinging state.

As shown in FIGS. 4 and 5, the base disk 12 of the aforesaid embodiment has extended outwards into a flat plate 32 at a given length; the flat plate 32 has a recess part 36 for receiving a retarding gear train 33; the outer edge of the recess part 36 is furnished with several short posts 35 for mounting a positioning plate 34 so as to facilitate the retarding gear train 33 fastened in the recess part 36. The inner edge of the retarding gear train 33 is engaged with the gear train 26, while the outer edge thereof is engaged with the small transmission gear 42 of the transmission assembly. The driving force is to be transmitted to the small transmission gear 42 through the driving gear 23 of the rotative ring 15, the gear train 26 and the retarding gear train 33. The retarding gear train 33 mounted in the recess part 36 is coupled with the rotative ring 15 by means of the gear train 26 (as shown in FIG. 4). The edge of the retarding gear train 33 is mounted with a transmission assembly; by means of the driving force of the rotative ring 15, the ornament on the transmission assembly can swing; the gear train 26 may replace the retarding gear, i.e., the gear train 26 can directly engage with the small transmission gear 42 of the transmission assembly (as shown in FIG. 5); in other words, the driving gear 23 of the rotative ring 15 can directly drive the transmission assembly through the gear train 26.

Referring to FIGS. 4 to 7 again, the swinging assembly 37 includes a small transmission gear 42, a positioning disk 43, an eccentric rod 45, a swinging rod 48 and two body members 41A and 41B; the top sides of the two body members 41A and 41B are provided with two opposite elongate openings 55 respectively; under the elongate opening 55, there is a shaft socket 53 for receiving a branch shaft 49 of the swinging rod 48. Under the shaft socket 53 of each body member 41A or 41B, there is a positioning flange 81 for mounting the bottom of the positioning disk 43; the positioning flange 81 can provide a resistant function. The bottom of the body member 41A in the swinging assembly 37 has an open recess 82, which is aligned to the open cut 54 of the positioning disk 43 in the same direction so as to facilitate the small transmission gear 42 under the positioning disk 43 to be engaged with, through such open cut 54 and open recess 82, the retarding gear train 33 or the gear train 26. The positioning disk 43 between the two body members 41A and 41B has a suitable thickness, and has an axle hole 44, while the bottom thereof has an open cut 54; the axle hole 44 is for receiving a short shaft 83 of the small transmission gear 42; the short shaft 83 is to be plugged into the shaft hole 84 of the eccentric rod 45. After the positioning disk 43 assembled together with the two body members 41A and 41B, the disk 43 will be fastened under the bottom of the positioning flange 81. After the positioning disk 43 with the small transmission gear 42 is mounted in the recess part 36 of the flat plate 32, the small transmission gear 42 will, through the open cut 54 and the open recess 82, engage with the retarding gear train 33. The short shaft 83 passing through the axle hole 44 of the positioning disk 43 is connected with the shaft hole 84 of the eccentric rod 45, and the small transmission gear 42 can drive the eccentric rod 45 to rotate.

The eccentric rod 45 has an arm plate 46 having a shaft hole 84 on one end thereof, while the other end thereof has a short post 47; the shaft hole 84 of the eccentric rod 45 is to be mounted over the short shaft 83 penetrated through the axle hole 44; the short post 47 is mounted in a guide channel 52 of the guide plate 51 under the swinging rod 48. The eccentric rod 45 is to be rotated together with the small transmission gear 42; the short post 47 on the arm plate 46 can move circularly to cause the swinging rod 48 to swing back and forth.

The swinging rod 48 in includes branch shafts 49, a round axle 50, and a guide plate 51; the branch shafts 49 are furnished on both sides of the round axle 50, and is pivotally connected with the shaft sockets 53 of the two body members 41A and 41B. The round axle 50 extends upwards from the branch shafts 49; the round axle 50 is connected with a connecting sleeve 56 mounted with an ornament. The lower end of the round axle 50 is connected with a guide plate 51, of which the bottom has a guide channel 52 to be coupled with the short post 47 of the eccentric rod 45. The branch shafts 49 are used as the shaft of the swinging rod 48. The small transmission gear 42 can drive the short post 47 on the eccentric rod 45 to move circularly so as to cause the swinging rod 48 to swing back and forth.

Before the swinging assembly 37 being assembled together with the two body members 41A and 41B, the short shaft 83 of the small transmission gear 42 penetrates through the positioning disk 43, being connected with the eccentric rod 45; the swinging rod 48 is pivotally connected, by means of the branch shafts 49, with the shaft sockets 53 of the body members 41A and 41B. The guide channel 52 of the guide plate 51 is pivotally mounted to the short post 47 of the eccentric rod 45. After the two body members 41A and 41B, the swinging rod 48 and the positioning disk 43 are assembled together as one piece, an independent swinging assembly 37 is formed. When the small transmission gear 42 of the swinging assembly 37 rotates, the circular motion of the eccentric rod 45 will be transformed into a swinging motion of the swinging rod 48 so as to have the swinging ornament 85 on the round axle 50 swung.

The swinging ornament 85 and the swinging assembly 37 are connected together by means of a connecting sleeve 56 having a round hole 57. The bottom surface of the connecting sleeve 56 and the swinging ornament 85 are set on one level; the round hole 57 of the connecting sleeve 56 is mounted on the round axle 50; the swinging ornament 85 will swing with the swinging assembly 37 simultaneously.

Figure 8:
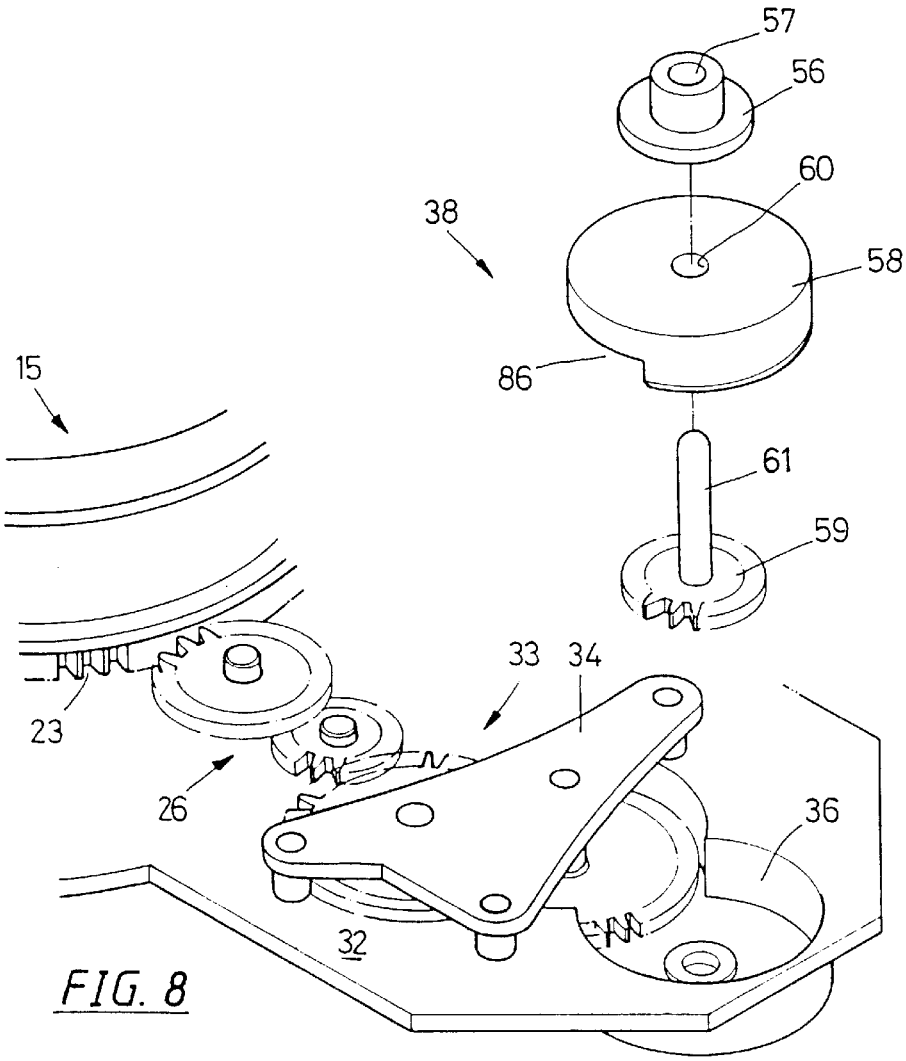
FIG. 8 is a disassembled view of the rotative assembly of the present invention, showing the structure relation thereof.
Figure 9:
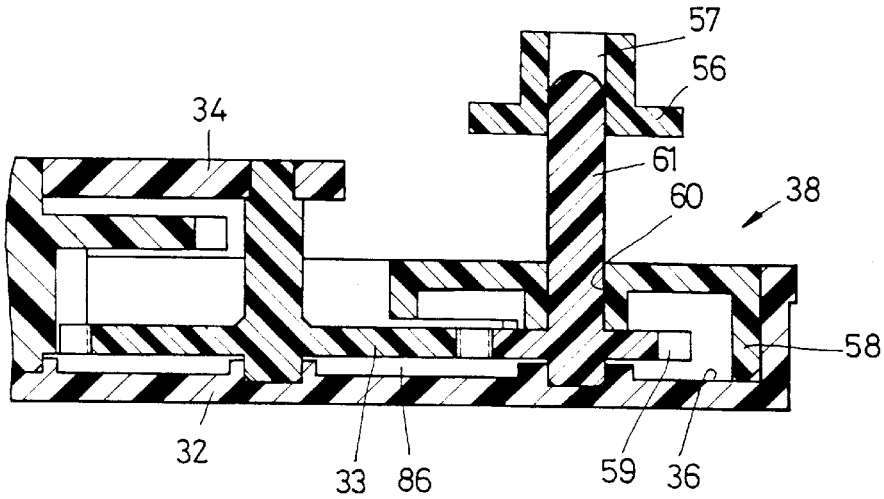
FIG. 9 is a fragmental section view of the present invention, showing the transmission structure of the rotative assembly.

Referring to FIGS. 8 and 9, a rotative assembly 38 is mounted in the recess part 36 of the flat plate 32 as shown in FIG. 4, and the rotative assembly 38 includes a positioning disk 58 and a gear 59; the outer diameter of the positioning disk 58 is to be fitted in recess part 36 to form into one unit. The bottom of the positioning disk 58 has an open cut 86, and the center of the disk 58 has a shaft hole 60 for receiving a shaft 61 of a gear 59. After the positioning disk 58 is mounted in the recess part 36, the open cut 86 will face to the retarding gear train 33 so as to have the gear 59 under the positioning disk 58 engaged with the retarding gear train 33. The upper end of the shaft 61 through the positioning disk 58 is mounted with the connecting sleeve 56, on which an ornament is fastened. The ornament 11 mounted on the shaft 61 will rotate upon the small transmission gear 42 rotating. The recess part 36 for receiving the rotative assembly 38 may be a recess part 36A as shown in FIG. 5 to use a gear 59 to engage with the gear train 26.

Referring to FIGS. 10 to 13, the displacing assembly 39 includes two body members 41A and 41B, a small transmission gear 42, a positioning disk 43, an eccentric rod 45, a displacing plate 63 and a gear 64; the inner wall of the body members 41A and 41B are furnished with two positioning flanges 81 respectively, which are used for positioning a positioning disk 43 mounted on a small transmission gear 42, and mounted with an arm plate 46 having a short post 47. After the displacing assembly 39 being mounted in the recess part 36 of the flat plate 32, the small transmission gear 42 will engage with the retarding gear train 33, or with the gear train 26 as shown in FIG. 5 upon using a recess part 36A; the short post 47 of the eccentric rod 45 is to engage with a guide channel 67 of the displacing plate 63. The circular motion of the short post 47 on the eccentric rod 45 will cause the displacing plate 63 to move back and forth. The two body members 41A and 41B each have a guide channel 62 above the positioning flange 81 for receiving the displacing plate 63. Above the guide channel 62 of the body member 41B, there is a gear rack 65, while the body member 41A has an elongate channel 88 on the same part as shown in the body member 41B; the top of the two body members have two top plates 89 respectively over the gear rack 65 or the elongate channel 88. The bottom of the displacing plate 63 has a guide channel 67 to be engaged with the short post 47 of the eccentric rod 45; the top side of the displacing plate 63 has a short rod 87 to be connected with a gear 64, which is set between the two body members 41A and 41B; the gear rack 65 of the body member 41B is to be engaged with the gear 64, and the body member 41A has an elongate channel 88 to provide a displacing space for gear 64; both body members 41A has an elongate channel 88 to provide a displacing space for gear 64; both body members 41A and 41B have two opposite top plates 89 respectively over the gear 64. Between the two top plates, there is a gap being used as a passage for the round shaft 66. The top plates 89 are in contact with the top surface of the gear 64; the round shaft 66 on the gear 64 is to be mounted with a displacing ornament.

The bottom of the displacing plate 63 has an elongate guide channel 67 to be engaged with the short post 47 of the eccentric rod 45. When the small transmission gear 42 under the positioning disk 43 is driven to rotate, the short post 47 in the guide channel 67 will move circularly so as to drive the positioning plate 63 to move along the guide channel 62; simultaneously, the gear 64 mounted on the short rod 87 of the displacing plate 63 will be guided with the gear rack 65 of the body member 41B, and an ornament mounted on the round shaft 66 will rotate synchronously.

Figure 10:
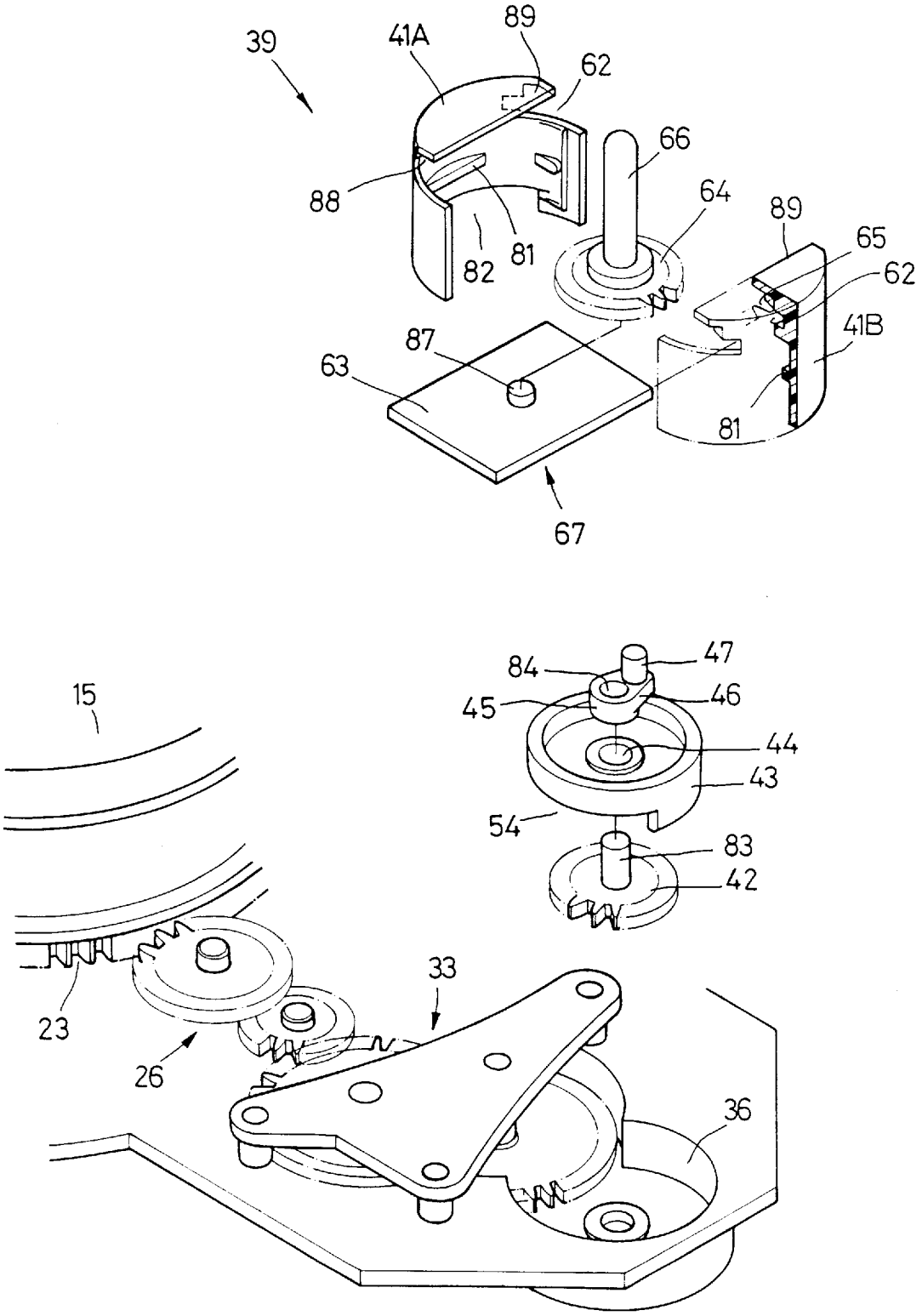
FIG. 10 is a disassembled view of the displacing assembly of the present invention, showing the structure relation of the assemblies thereof.
Figure 11:
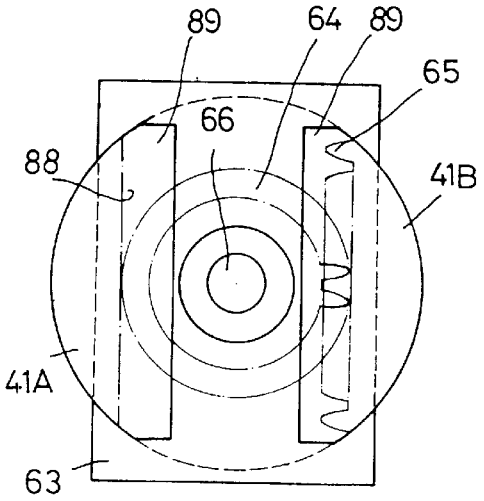
FIG. 11 is a plane view of the present invention, showing a top view of the displacing assembly thereof.
Figure 14:
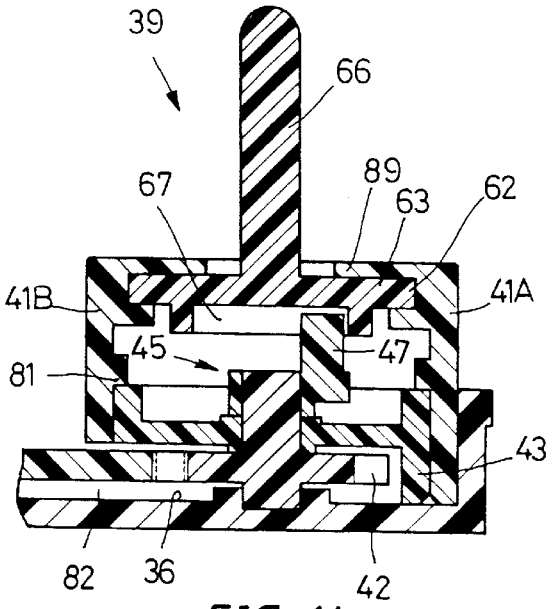
FIG. 14 is a fragmental section view of the present invention, showing the structure of another displacing assembly thereof.
Figure 12:
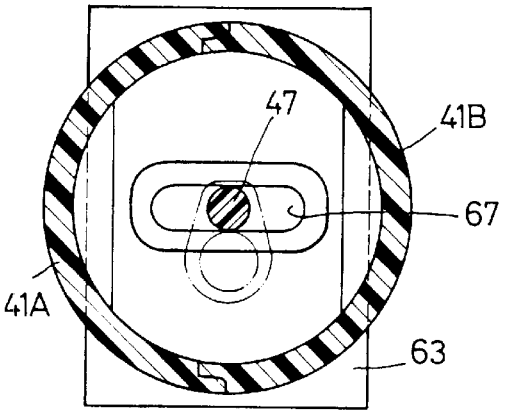
FIG. 12 is a sectional view taken along line 12—12 as showing in FIG. 13.
Figure 13:
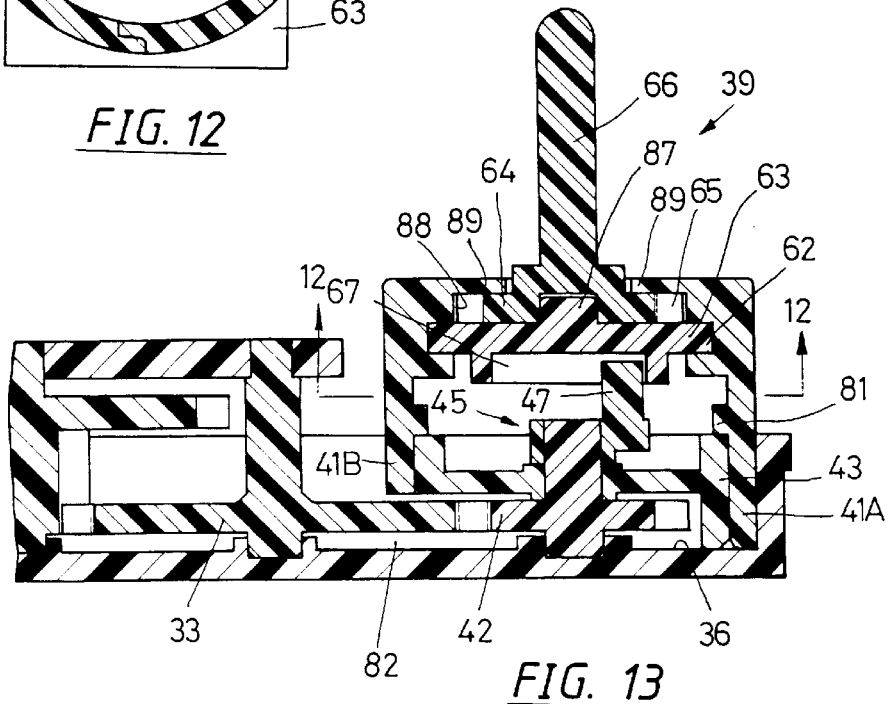
FIG. 13 is a fragmental section view of the present invention, shown the structure relation of the displacing assembly thereof.
Figure 15:
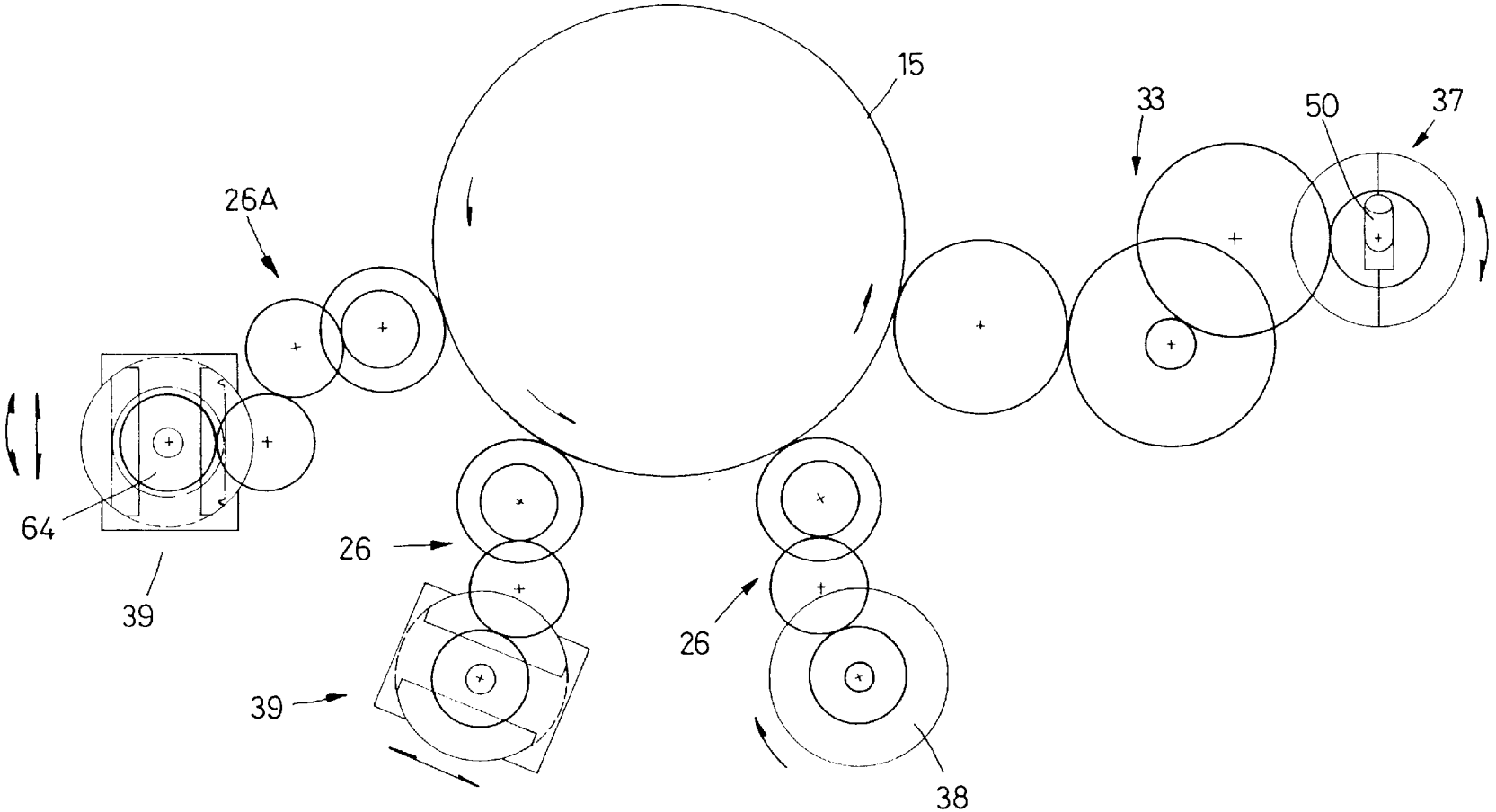
FIG. 15 is a plane view of the present invention, showing the relation between the rotative ring and the various transmission assemblies thereof.

Another embodiment of the displacing assembly 39 (as shown in FIG. 14) will have a minor change in comparison with that in FIG. 10, i.e., the short rod 87 of the displacing plate 63 in FIG. 10 is replaced with an elongate round shaft 66. The displacing plate 63 is fitted into the guide channel 62; the top edge of the guide channel 62 is defined with the top plates 89. A gap is furnished between the two top plates so as to form into a passage for the round shaft 66. The guide channel 67 under the displacing plate 63 is engaged with the short post 47 of the eccentric rod 45. When the eccentric rod 45 rotates, the short post 47 thereon will transform the circular motion thereof into a back-and-forth motion of the displacing plate 63, and then an ornament mounted on the round shaft 66 will move back and forth.

Referring to FIGS. 4 to 15, the aforesaid transmission assembly can be engaged with the retarding gear train 33 or the gear train 26 before being engaged with the driving gear 23 under the rotative ring 15. When the rotative disk 15 rotates, the swinging assembly 37 will swing, and the rotative assembly 38 will rotate; the displacing assembly 39 will move, too. In the recess part 36 in the base disk 12, several same or different assemblies may be mounted. Each of the aforesaid assemblies will be mounted in place with the round axle 50 and the connecting sleeves 56. During packing and transportation, the transmission assembly and the ornaments may be packed separately so as to prevent the round axle from being damaged as a result of impact. The connection between the various ornaments and the round axle 50 of the transmission assembly may be done by means of different and versatile methods.

I claim:

1. A transmission structure for ornaments, comprising:

a base disk including a salient ring, a plurality of supporting posts, and at least one positioning plate on a top side thereof, said at least one positioning plate being furnished with positioning studs and small round holes;

at least one gear train mounted on said supporting posts;

a still disk mounted on said at least one positioning plate of said base disk via said positioning studs and small round holes, said still disk having a lower round surface;

a rotative ring having a substantially cylindrical shape, said rotative ring having an inner-ring shoulder on an inner surface thereof and a driving gear on a bottom thereof, said rotative ring being mounted around said salient ring of said base disk with said inner-ring shoulder in contact with an end of said salient ring and with said driving gear engaged with said at least one gear train via an inside gear thereof;

a rotative disk mounted around an outer surface of said at least one positioning plate of said base disk, said rotative disk having a circular surface and an inner round surface, said inner round surface being in contact with said lower round surface of said still disk, said rotative disk being provided with an inner gear on an inner bottom thereof, said inner gear being engaged with said at least one gear train via an outside gear thereof;

a positioning cup being mounted on said inner-ring shoulder of said rotative ring, said positioning cup including hooks for preventing said rotative ring from moving upwards;

a music generator assembled together with a driving unit, said music generator and said driving unit being mounted in said positioning cup, said driving unit including a small gear; and a round member having a ring-shaped plate thereon and a hollow space therein, said hollow space including an internal gear which is engaged with said small gear of said driving unit, said round member being connected with an upper part of said rotative ring, wherein a first rotative ornament is mounted on said ring-shaped plate of said round member, a second rotative ornament is connected to said rotative disk and a still ornament is mounted on said still disk.

2. A transmission structure according to claim 1, wherein:

said at least one gear train is mounted on said plurality of supporting posts at an outer edge surface of said base disk, said supporting posts being one of odd or even in number;

said driving gear of said rotative ring is engaged with an inner edge of said at least one gear train; and said inner gear of said rotative disk is engaged with an outer edge of said at least one gear train.

3. A transmission structure according to claim 1, wherein:

said at least one gear train is mounted on an outer edge surface of said base disk; and said gear train has at least one gear furnished between said driving gear of said rotative ring and said inner gear of said rotative disk.

4. A transmission structure according to claim 1, wherein:

said at least one gear train is mounted on an outer edge surface of said base disk; and said at least one gear train is substantially a retarding gear train including at least two gears, one of said at least two gears being a retarding gear.

5. A transmission for ornaments, comprising:

a base disk including a salient ring, a plurality of supporting posts, and at least one positioning plate on a top side thereof, said base disk also including a flat plate extending from an outer edge surface thereof, said flat plate being furnished with at least one recess part;

at least one gear train mounted on said supporting posts;

a rotative ring having a substantially cylindrical shape, said rotative ring having an inner-ring shoulder on an inner surface thereof and a driving gear on a bottom thereof, said rotative ring being mounted around said salient ring of said base disk with said inner-ring shoulder in contact with an end of said salient ring and with said driving gear engaged with said at least one gear train via an inside gear thereof;

a still disk mounted on said at least one positioning plate of said base disk to prevent said at least one gear train from separating unintentionally;

a positioning cup being mounted on said inner-ring shoulder of said rotative ring, said positioning cup including hooks for preventing said rotative ring from moving upwards;

a music generator assembled together with a driving unit, said music generator and said driving unit being mounted in said positioning cup, said driving unit including a small gear;

a round member having a ring-shaped plate thereon and a hollow space therein, said hollow space including an internal gear which is engaged with said small gear of said driving unit, said round member being connected with an upper part of said rotative ring; and at least one transmission assembly mounted in said at least one recess part on said flat plate, said at least one transmission assembly including at least a positioning disk and a small transmission gear, said small transmission gear having a short shaft which passes through an axle hole in said positioning disk and is connected with an eccentric rod, said small transmission gear being engaged with said at least one gear train via an outside gear thereof.

6. A transmission structure according to claim 5, wherein:

said at least one gear train is mounted on said plurality of supporting posts at an outer edge surface of said base disk, said supporting posts being one of odd or even in number;

said driving gear of said rotative ring is engaged with an inner edge of said at least one gear train; and said small transmission gear of said at least one transmission assembly is engaged with an outer edge of said at least one gear train.

7. A transmission structure according to claim 5, wherein:

said at least one gear train is mounted on an outer edge surface of said base disk; and said at least one gear train is substantially a retarding gear train including at least two gears, one of said at least two gears being a retarding gear.

8. A transmission structure according to claim 5, further comprising:

a retarding gear train mounted between said at least one gear train and said small transmission gear of said at least one transmission assembly.

9. A transmission structure according to claim 5, wherein said at least one transmission assembly is a swinging assembly, comprising:

two body members each having an elongate opening formed in a top part thereof, a shaft socket furnished under said elongate opening and a positioning flange furnished under said shaft socket, said positioning flange being positioned upon said positioning disk with said body members assembled together;

a swinging rod having a round axle with two branch shafts on opposite sides of said round axle, said two branch shafts being fitted in said shaft sockets of said two body members, respectively, said round axle extending upwards at a length and being furnished with a guide plate having a lateral guide channel;

wherein said positioning disk has an open cut on a bottom thereof, said eccentric rod has an arm plate with a shaft hole at one end and a short post at the other end, and said eccentric rod, said positioning disk and said small transmission gear are fitted in a space between said body members with said small transmission gear mounted under said positioning disk, said shaft hole of said arm plate connected with said short shaft after passing through said positioning disk, and said short post of said arm plate engaged with said guide channel of said guide plate of said swinging rod.

10. A transmission structure according to claim 5, wherein said at least one transmission assembly is a displacing assembly to move back and forth, comprising:

two body members each having a positioning flange in a lower inside thereof, a guide channel furnished above said positioning flange and a top plate, said positioning flange being positioned upon said positioning disk mounted between said body members;

a gear rack provided above said guide channel in one of said body members below said top plate thereof;

an elongate channel provided above said guide channel in the other of said body members below said top plate thereof;

a displacing plate mounted in said guide channels and between said two body members, said displacing plate having a lateral guide channel on a bottom thereof and a short rod on a top thereof; and a gear mounted between said displacing plate and said top plates of said two body members, said gear having an elongate round shaft which extends upwards and a rod socket which is mounted on said short rod of said displacing plate, said gear being engaged with said gear rack of said one of said body members;

wherein said positioning disk has an open cut on a bottom thereof, said eccentric rod has an arm plate with a shaft hole at one end and a short post at the other end, and said eccentric rod, said positioning disk and said small transmission gear are fitted in a space between said body members with said small transmission gear mounted under said positioning disk, said shaft hole of said arm plate connected with said short shaft after passing through said positioning disk, and said short post of said arm plate engaged with said lateral guide channel of said displacing plate.

11. A transmission structure according to claim 5, wherein said at least one transmission assembly is a displacing assembly to move back and forth, comprising:

two body members each having a positioning flange in a lower inside thereof, a guide channel furnished above said positioning flange and a top plate furnished above said guide channel, said positioning flange being positioned upon said positioning disk mounted between said body members; and a displacing plate mounted in said guide channels and between said two body members, said displacing plate having a lateral guide channel on a bottom thereof and an elongate round shaft on a top thereof for connecting with a displacing ornament;

wherein said positioning disk has an open cut on a bottom thereof, said eccentric rod has an arm plate with a shaft hole at one end and a short post at the other end, and said eccentric rod, said positioning disk and said small transmission gear are fitted in a space between said body members with said small transmission gear mounted under said positioning disk, said shaft hole of said arm plate connected with said short shaft after passing through said positioning disk, and said short post of said arm plate engaged with said lateral guide channel of said displacing plate.

12. A transmission structure for ornaments, comprising:

a base disk including a salient ring, a plurality of supporting posts, and at least one positioning plate on a top side thereof, said base disk also including a flat plate extending from an outer edge surface thereof, said flat plate being furnished with at least one recess part;

at least one gear train mounted on said supporting posts;

a rotative ring having a substantially cylindrical shape, said rotative ring having an inner-ring shoulder on a inner surface thereof and a driving gear on a bottom thereof, said rotative ring being mounted around said salient ring of said base disk with said inner-ring shoulder in contact with an end of said salient ring and with said driving gear engaged with said at least one gear train via an inside gear thereof;

a still disk mounted on said at least one positioning plate of said base disk to prevent said at least one gear train from separating unintentionally;

a positioning cup being mounted on said inner-ring shoulder of said rotative ring, said positioning cup including hooks for preventing said rotative ring from moving upwards;

a music generator assembled together with a driving unit, said music generator and said driving unit being mounted in said positioning cup, said driving unit including a small gear;

a round member having a ring-shaped plate thereon and a hollow space therein, said hollow space including an internal gear which is engaged with said small gear of said driving unit, said round member being connected with an upper part of said rotative ring; and at least one rotative assembly mounted in said at least one recess part on said flat plate, said at least one rotative assembly including at least a positioning disk and a small transmission gear, said positioning disk having an outer diameter fitted in said recess part on said flat plate and connected therewith, said positioning disk having an open cut on one side of a bottom thereof and a shaft hole in a center thereof, said small transmission gear being mounted in a space under said positioning disk and having an elongate shaft in a center thereof which passes through said shaft hole of said positioning disk and is connected with a connecting sleeve of a rotative ornament, said small transmission gear being engaged with said at least one gear train on said base disk.

* * * * *